US011078006B1

(12) United States Patent
Young

(10) Patent No.: US 11,078,006 B1
(45) Date of Patent: Aug. 3, 2021

(54) COOLER INSERT

(71) Applicant: Norman D. Young, Springville, UT (US)

(72) Inventor: Norman D. Young, Springville, UT (US)

( * ) Notice: Subject to any disclaimer, the term of this patent is extended or adjusted under 35 U.S.C. 154(b) by 0 days.

(21) Appl. No.: 17/144,822

(22) Filed: Jan. 8, 2021

(51) Int. Cl.
*B65D 81/26* (2006.01)

(52) U.S. Cl.
CPC ..... *B65D 81/262* (2013.01)

(58) Field of Classification Search
CPC .... B65D 81/262; B65D 81/26; B65D 81/261; F25D 2303/081; F25D 2331/812
USPC ..... 220/694
See application file for complete search history.

(56) References Cited

U.S. PATENT DOCUMENTS

| | | | |
|---|---|---|---|
| 4,307,581 | A | 12/1981 | Reid |
| 4,424,687 | A | 1/1984 | Morgan |
| 4,478,337 | A | 10/1984 | Flum |
| 4,565,074 | A | 1/1986 | Morgan |
| 5,052,184 | A | 10/1991 | Jarvis |
| 5,052,185 | A | 10/1991 | Spahr |
| 5,655,460 | A | 8/1997 | Boonstra |
| 6,050,663 | A | 4/2000 | Schoellmann |
| 6,126,124 | A | 10/2000 | Wagner |
| 6,357,606 | B1 | 3/2002 | Henry |
| 6,405,557 | B1 | 6/2002 | DeCastro et al. |
| 6,626,006 | B1 | 9/2003 | Tedder |
| 6,763,959 | B2 | 7/2004 | Tedder |
| 7,313,928 | B2 | 1/2008 | Girard |
| 8,016,139 | B2 | 9/2011 | Hanners et al. |
| 8,065,889 | B1 | 11/2011 | Silberman |
| 9,188,379 | B2 | 11/2015 | Jimenez |
| D785,411 | S | 5/2017 | Kendrick |
| 10,077,934 | B1 | 9/2018 | Dizon |
| 10,612,828 | B1 | 4/2020 | Engelbrect |
| 2007/0012069 | A1* | 1/2007 | Girard ..... F25D 3/08 62/459 |
| 2017/0023292 | A1 | 1/2017 | Marinelli |

* cited by examiner

*Primary Examiner* — Anthony D Stashick
*Assistant Examiner* — L Kmet
(74) *Attorney, Agent, or Firm* — Morriss O'Bryant Compagni Cannon, PLLC

(57) ABSTRACT

A cooler insert includes a rectangular planar plate having a plurality of legs depending from a bottom of the plate. The plate has a plurality of channels defining breakage zones along their lengths to each form a removable section that can be selectively removed from the plate by breaking the plate along the breakage zone to adjust a dimension of the plate for fitting within a particularly sized cooler. Square apertures are positioned at each intersection of the channels to form a beveled corner between the channels when the plate is separated at the intersection.

19 Claims, 10 Drawing Sheets

COOLER INSERT

TECHNICAL FIELD

This invention relates to inserts for coolers and is more particularly to an insert for placement on a lower surface of the interior of a cooler to allow water from melted ice to accumulate below the insert while supporting food products there above.

BACKGROUND OF THE INVENTION

Various prior art inserts have been developed for placement into coolers to support food products above accumulating liquid inside and at the bottom of a cooler to allow liquid, such as water from melting ice to drain away from such food products. Such inserts are often removable and can be placed inside the cooler and rest on the bottom interior surface to essentially form a shelf. Products placed inside the cooler can then rest upon the insert and are thus held above the bottom interior surface of the cooler based on a vertical height of the insert. The inserts may include drainage apertures in the insert that allow liquids to flow through the insert to the space below the insert and accumulate at the bottom of the cooler. The draining of liquid into the space below the insert separates such liquid from the products above the insert thereby reducing the possibility that such products become saturated by the liquid.

In U.S. Pat. No. 5,636,524 to Woods et al. 7, an insert in the form of an inverted shallow basket has a plurality of openings forming draining apertures through which water may pass. The insert, when placed into a cooler, separates the foodstuffs and ice away from water that can flow through the draining apertures into the space below the insert. Among other things, the insert is configured to snugly engage the cooler walls of the interior causing a user to ensure the right size of insert is purchased for use in the cooler. Should a user purchase the wrong sized insert or try to use the insert on a smaller cooler, the insert would be unusable.

In U.S. Pat. No. 6,574,983 to Smith et al., a cooler having insert fixedly attached to the interior is disclosed. A lower insert has apertures and defines a space between the lower surface of the interior and the portion of the interior in which products are stored. Ice can be placed with the products above the insert or be completely separated therefrom by placement below the lower insert. Water from melting ice drains through the apertures into the space below insert. Because the insert is hingedly mounted to the cooler, it is not easily removable and can complicate cleaning. The insert is not easily adaptable for use in a smaller cooler.

In U.S. Pat. No. 6,405,557 to DeCastro, an insert has a first, bottom surface and a second, top surface. The first surface has a plurality of apertures that extend through the insert to the second surface upon which products and ice are placed. A side perimeter extending downwardly away from the second surface supports the insert on a lower surface of the interior of the cooler to create a space between the lower surface and the second surface. Water from ice can flow through the apertures into the space. The side perimeter may provide insufficient support for goods and ice placed on the center of the insert and may cause the insert to sag or break, possibly exposing the goods to the liquid in the space thereunder. Also, the insert is designed to be of fixed dimension. Thus, an insert purchased for a larger cooler cannot necessarily be adapted for use in a smaller cooler.

In U.S. Pat. No. 7,313,928 to Girard, an insert for a cooler is sized and shaped for placement on a lower surface of the cooler while supporting foodstuffs placed on the insert. Draining apertures on the insert allow liquid to drain away from foodstuffs into a space below the insert and thereby separates liquid from foodstuffs. Draining apertures are formed from internal walls having curved sections and are sized to facilitate insertion of human fingers therein during cleaning, the curved sections and size of apertures facilitating cleaning. Guidelines marked on the insert allow the insert to be cut to be adapted in size and shape to lower surface of cooler. In order to adjust the size of the insert, the insert must be cut. Such cutting tools, however, are not always readily available thus eliminating the ability to modify the size of the insert without such tools.

Accordingly, there is a need for an improved cooler insert that can be adjusted in size to fit a plurality of cooler sizes and that when adjusted eliminates sharp corners.

SUMMARY OF THE INVENTION

A cooler insert includes a rectangular planar plate having a plurality of legs depending from a bottom of the plate. The plate has a plurality of channels defining breakage zones along their lengths to each form a removable section that can be selectively removed from the plate by breaking the plate along the breakage zone to adjust a dimension of the plate for fitting within a particularly sized cooler. Square apertures are positioned at each intersection of the channels to form a beveled corner between the channels when the plate is separated at the intersection.

In one embodiment, a rectangular planar plate defines a plurality of drainage apertures extending through the plate and spaced over a surface of the plate to provide drainage over an entirety of the plate at a location of each drainage aperture.

In another embodiment, a plurality of legs depend from a bottom of the plate, the plurality of legs spaced about a perimeter of the plate and dispersed throughout a body of the plate to provide support of the plate over its entire surface and to support the plate above a bottom interior surface of a cooler.

In another embodiment, the plate defines a first plurality of channels in a top surface of the plate, the plurality of channels evenly spaced from and parallel to a first edge of the plate. Each of the plurality of channels forms a breakage zone along its length and forms at least one removable section of the plate so that the removable section of the plate can be selectively removed from the plate by breaking the plate along the breakage zone to adjust a dimension of the plate in one direction.

In another embodiment, the plate defines another channel in the top surface of the plate oriented perpendicular to the first plurality of channels and is spaced from and parallel to a second edge of the plate. The at least one second channel forms a second breakage zone along its length and forms at least one second removable section of the plate so that the at least one second removable section of the plate can be selectively removed from the plate by breaking the plate along the second breakage zone to adjust a second dimension of the plate in a second direction. and In yet another embodiment, the plate defines a square aperture at each intersection of the first plurality of channels and the at least one second channel so as to form a beveled edge at a corner between one of the first plurality of channels and the at least one second channel when the plate is separated along the one of the first plurality of channels and the at least one second channel.

In still another embodiment, each of the first removable sections and the second removable sections have at least one of the plurality of legs attached thereto to support the first removable section and second removable section independently of the body of the plate and one another.

In another embodiment, a width and a length of the plate can be adjusted in approximately 1 inch increments by selectively removing one or more of the first and second removable sections.

In yet another embodiment, a first plurality of bottom channels is formed in a bottom surface of the plate. Each of the first plurality of bottom channels is aligned with and positioned directly opposite one of the first plurality of channels and at least one second bottom channel is aligned with and positioned directly opposite the at least one second channel.

In another embodiment, each set of the first plurality of bottom channels and the first plurality of channels form a first elongated breakage zone and the at least one second bottom channel and the at least one second channel form a second elongated breakage zone.

In still another embodiment, each channel extends from one plate edge to an opposite plate edge.

In another embodiment, the first and second elongated breakage zones define thinned sections in the plate along their respective lengths to facilitate breakage of the plate along their respective lengths to adjust a length or width of the plate.

In yet another embodiment, each of the plurality of legs is positioned about a perimeter of the plate to support edges of the plate and also laterally spaced over interior portions of the plate to support the body of the plate to prevent sagging over its entire surface when foodstuffs, ice or products are placed on top of the plate.

In another embodiment, each removable section is provided with one or more legs depending on a size of the removable section to prevent flexing of one removable section relative to an adjacent removable section that could otherwise cause breakage along a channel from weight being place on the plate or any removable section.

In still another embodiment, each removable section is independently supported by one or more of the plurality of legs in a manner and configuration similar to an adjacent removable section or body of the plate.

In yet another embodiment, the plate includes a plurality of apertures sized and shaped to receive a proximal end of one of the plurality of legs to secure the one of the plurality of legs to the plate.

In another embodiment, the plate and legs are integrally molded together.

In yet another embodiment, each of the legs is conical in shape having a wider top portion adjacent the plate and that narrows toward a distal end of the leg.

In still another embodiment, each of the plurality of square apertures is oriented so that corners of the aperture are positioned at a respective low point of one of the first plurality of channels or at least one second channel.

In another embodiment, each interior face of the square aperture is oriented at a 45 degree angle to a long axis of the respective channel.

In yet another embodiment, each interior face of the square aperture is spaced a distance from a respective channel corner defined by an intersection between adjacent sides of intersecting channels.

In still another embodiment, a first angle between a face of the square aperture and a first adjacent edge of a first broken channel is approximately 135 degrees.

In another embodiment, a second angle between the face of the square aperture and a second adjacent edge of a second broken channel opposite the first broken channel is approximately 135 degrees to form a beveled corner between the first adjacent edge and the second adjacent edge.

In yet another embodiment, the plate is formed from polystyrene or other materials suitable for facilitating the zone breakage feature previously mentioned.

Other aspects, features, and advantages will become apparent from the following detailed description when taken in conjunction with the accompanying drawings, which are a part of this disclosure and which illustrate, by way of example, principles of the inventions disclosed.

BRIEF DESCRIPTION OF THE DRAWINGS

When considered in connection with the following illustrative figures, a more complete understanding of the present invention may be derived by referring to the detailed description. In the figures, like reference numbers refer to like elements or acts throughout the figures. Various embodiments of the present invention are shown and described in reference to the numbered drawings.

DETAILED DESCRIPTION OF THE INVENTION

Figure 1:
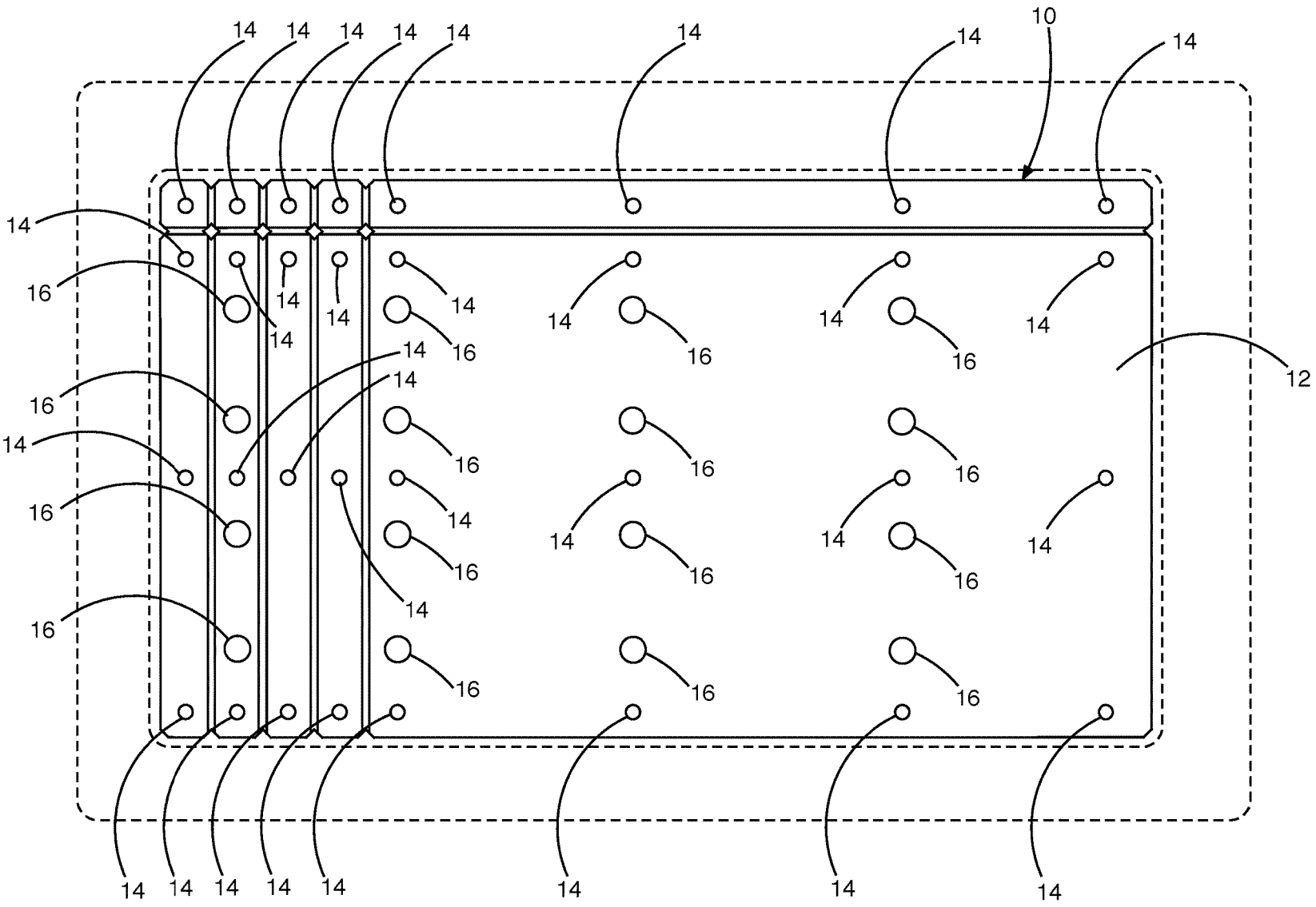
FIG. 1 is a top plan view of a first embodiment of an insert for a cooler in accordance with the principles of the present invention.

The invention and accompanying drawings will now be discussed in reference to the numerals provided therein so as to enable one skilled in the art to practice the present invention. The drawings and descriptions are exemplary of various aspects of the invention and are not intended to narrow the scope of the appended claims. Unless specifically noted, it is intended that the words and phrases in the specification and the claims be given their plain, ordinary, and accustomed meaning to those of ordinary skill in the applicable arts. It is noted that the inventor can be his own lexicographer. The inventor expressly elects, as his own lexicographer, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventor's intent and desire that the simple, plain and ordinary meaning to the terms be applied to the interpretation of the specification and claims.

The inventor is also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventor is fully informed of the standards and application of the special provisions of 35 U.S.C. § 112(f). Thus, the use of the words "function," "means" or "step" in the Detailed Description of the Invention or claims is not intended to somehow indicate a desire to invoke the special provisions of 35 U.S.C. § 112(f), to define the invention. To the contrary, if the provisions of 35 U.S.C. § 112(f) are sought to be invoked to define the inventions, the claims will specifically and expressly state the exact phrases "means for" or "step for" and the specific function, without also reciting in such phrases any structure, material or act in support of the function. Thus, even when the claims recite a "means for . . . " or "step for . . . " if the claims also recite any structure, material or acts in support of that means or step, or that perform the recited function, then it is the clear intention of the inventor not to invoke the provisions of 35 U.S.C. § 112(f). Moreover, even if the provisions of 35 U.S.C. § 112(f) are invoked to define the claimed inventions, it is intended that the inventions not be limited only to the specific structure, material or acts that are described in the illustrated embodiments, but in addition, include any and all structures, materials or acts that perform the claimed function as described in alternative embodiments or forms of the invention, or that are well known present or later-developed, equivalent structures, material or acts for performing the claimed function.

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, devices and technologies to which the disclosed inventions may be applied. Thus, the full scope of the inventions is not limited to the examples that are described below.

Figure 2:
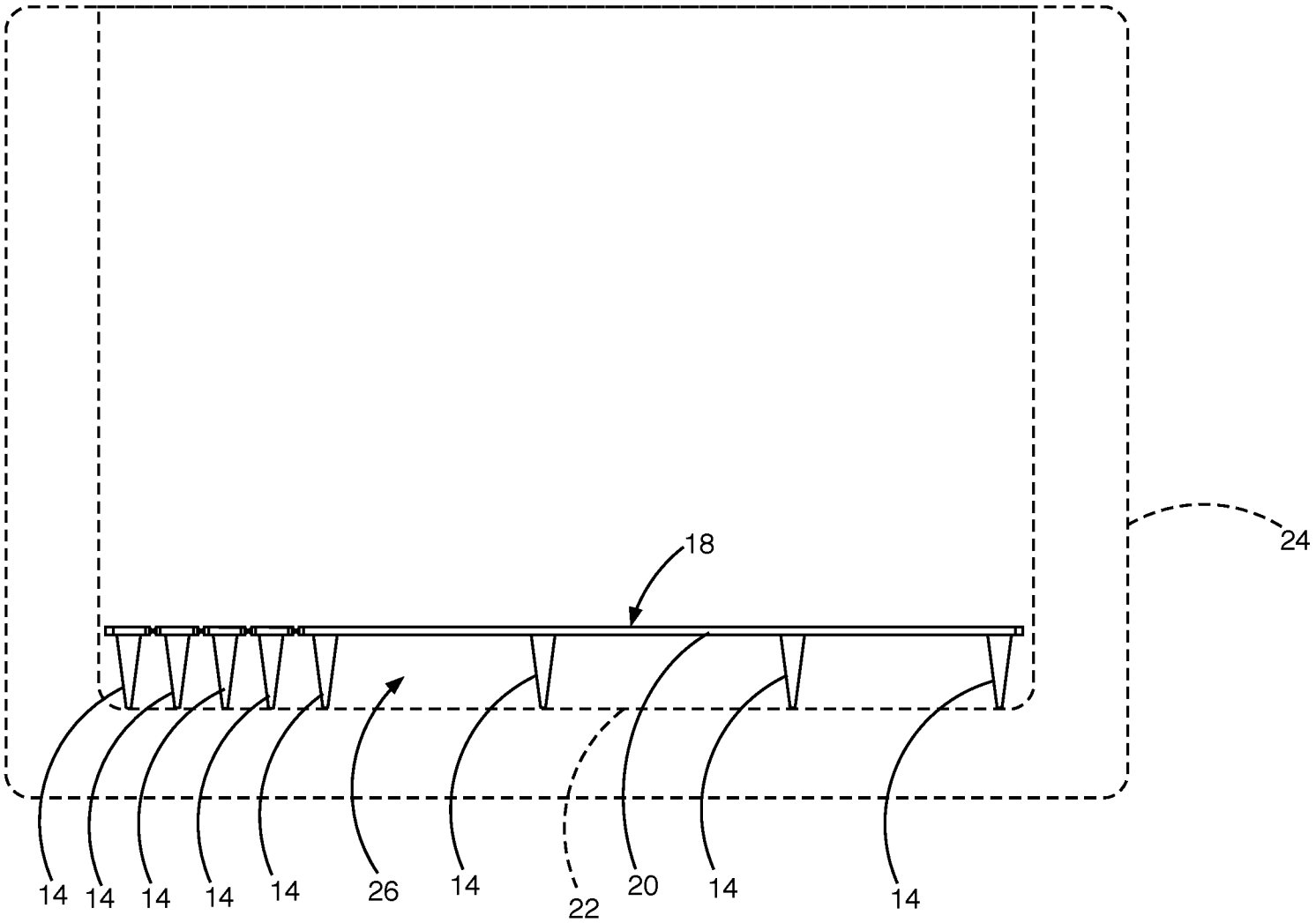
FIG. 2 is a side plan view of the insert for a cooler shown in FIG. 1.

Referring now to FIGS. 1 and 2, cooler insert, indicated generally at 10, is comprised of a planar plate 12 supported by a plurality of legs 14. The legs 14 are spaced about the perimeter of the plate 12 and dispersed throughout the body of the plate 12 to provide support of the plate over its entire surface. The plate 12 defines a plurality of drainage apertures 16 that extend through the plate 12. The drainage apertures 16 are spaced over the surface of the plate 12 so to provide drainage over the entire plate at a location of each drainage aperture 16. Thus, each drainage aperture 16 extends from a top surface 18 of the plate 12 to a bottom surface 20 of the plate 12 to allow liquid that accumulates on the top surface 18 to flow through the drainage apertures 16. The legs 14 depend from the bottom surface 20 of the plate 12 and rest upon an interior bottom surface 22 of a cooler 24 to form a space 26 between the bottom surface 20 of the plate 12 and the interior bottom surface 22 of the cooler 24. This space 26 effectively forms a reservoir for the accumulation of water from melted ice and other liquids within the cooler 24 (such as leaking liquid from foodstuffs) to keep such water and liquids from remaining in contact with any foodstuffs or products within the cooler 24 and placed on the plate 12. Essentially, the surface 18 of the plate 12 forms an interior shelf within the cooler 24 for supporting foodstuffs and/or products within the cooler 24. The dimensions of the plate 12 (length and width) are configured to reside within the cooler 24 so that the outer surface edges of the plate 12 are adjacent the respective interior walls of the cooler 24 with a relatively small gap (e.g., 1/16 inch or less to ½ inch) between the plate 12 and the interior walls of the cooler 24. This ensures that foodstuffs positioned on top of the plate 12 cannot fall between the edges of the plate 12 and the sidewalls of the cooler 24.

Figure 3:
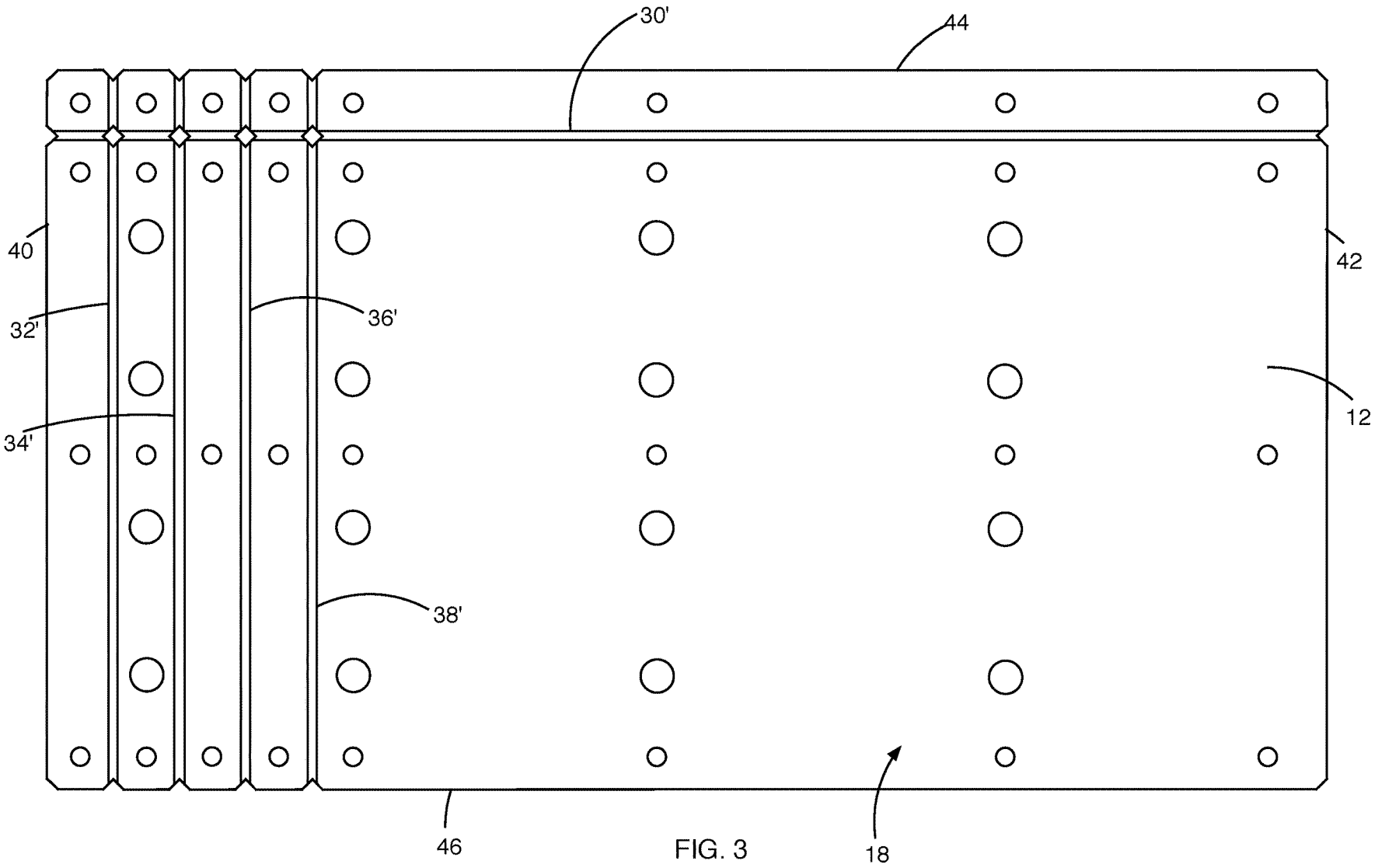
FIG. 3 is another top plan view of the insert for shown in FIG. 1.

As shown in FIG. 3, the top surface 18 of the plate 12 defines a plurality of channels 30', 32', 34', 36' and 38'. Each channel 30', 32', 34', 36' and 38' extends a depth into the top surface 18 of the plate 12. The channel 30' extends from proximate the plate edge 40 to the plate edge 42 and is parallel to and spaced approximately 1 inch from the long plate edge 44. Channel 32' extends from proximate the plate edge 44 to the plate edge 46 and is parallel to and spaced approximately 1 inch from the short plate edge 40. Channel 34' extends from proximate the plate edge 44 to the plate edge 46 and is parallel to and spaced approximately 1 inch from channel 32' and 2 inches from the short plate edge 40. Channel 36' extends from proximate the plate edge 44 to the plate edge 46 and is parallel to and spaced approximately 1 inch from channel 34' and 3 inches from the short plate edge 40. Channel 38' extends from proximate the plate edge 44 to the plate edge 46 and is parallel to and spaced approximately 1 inch from channel 36' and 4 inches from the short plate edge 40.

Figure 4:
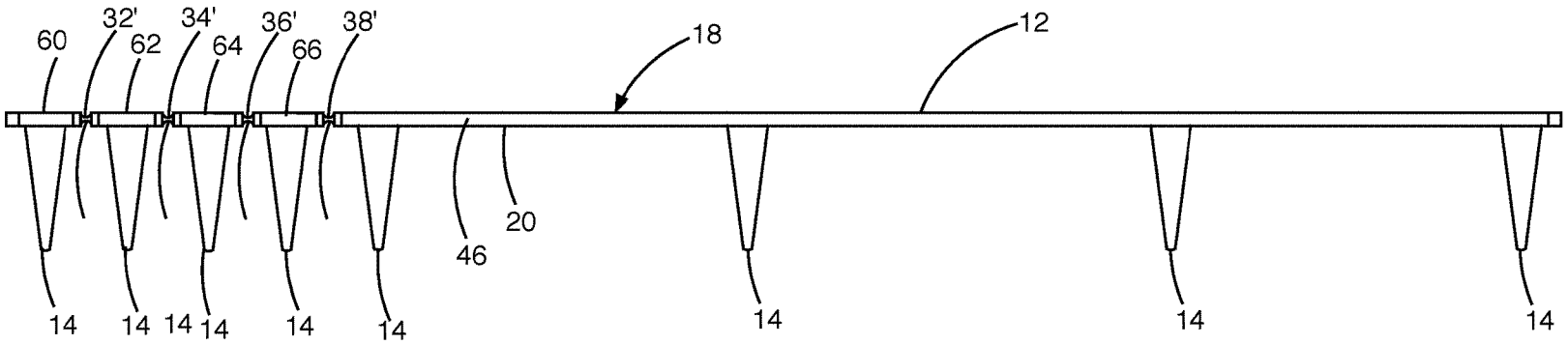
FIG. 4 is another side plan view of the insert for a cooler shown in FIG. 1.
Figure 6:
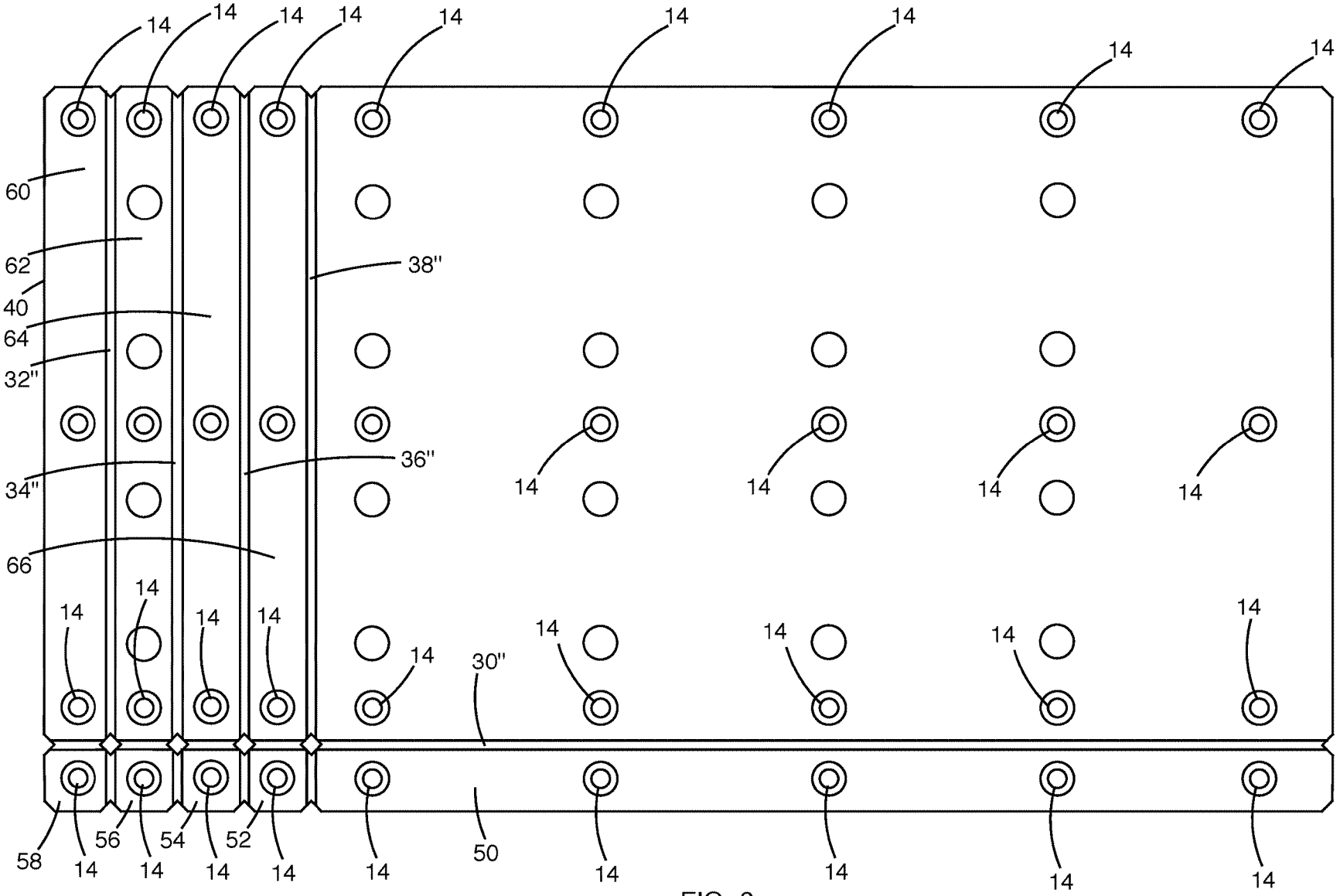
FIG. 6 is a bottom plan view of the insert for a cooler shown in FIG. 1.

As shown in FIG. 4, the bottom surface 20 of the plate 12 defines a plurality of channels 32", 34", 36" and 38" that are aligned with and directly opposite the plurality of channels 32', 34', 36' and 38' in the top surface 18. Each channel 32", 34", 36" and 38" extends a depth into the bottom surface 20 of the plate 12 so as to form webs between each pair of channels. As such, channel 32" extends from proximate the plate edge 44 to the plate edge 46 and is parallel to and spaced approximately 1 inch from the short plate edge 40. Channel 34" extends from proximate the plate edge 44 to the plate edge 46 and is parallel to and spaced approximately 1 inch from channel 32" and 2 inches from the short plate edge 40. Channel 36" extends from proximate the plate edge 44 to the plate edge 46 and is parallel to and spaced approximately 1 inch from channel 34" and 3 inches from the short plate edge 40. Channel 38" extends from proximate the plate edge 44 to the plate edge 46 and is parallel to and spaced approximately 1 inch from channel 36" and 4 inches from the short plate edge 40. A set of legs 14 are provided for each section of the plate separated by the channels so as to provide individual support for each such section of the plate 12. In addition, legs 14 are dispersed over the bottom surface 20 of the main body of the plate 12 so as to provide adequate support for the plate 12 over its entire surface. Thus, legs 14 are provided not only about the perimeter of the plate 12 to support the edges of the plate 12 but also laterally spaced over the interior portions of the plate 12 to support the middle portion of the plate 12 and to prevent sagging over its entire surface when foodstuffs, ice and/or products are placed on top of the plate 12. Each removable section 60, 62, 64 and 66, as well as removable sections 50, 52, 54, 56 and 58 each are provided with one or more such legs 14 (depending on the size of the respective section) so as to provide individual support for that section and the adjacent section to prevent flexing of one removable section relative to an adjacent removable section that could cause breakage along a channel from weight being place on the plate 12 or any individual removable section. That is, as shown in FIGS. 1 and 6, each removable section is independently supported by one or more legs 14 in a manner and configuration similar to the adjacent section or plate portion. This ensures that the removable sections are equally and uniformly supported relative to one another when a load is place on the plate 12.

Figure 5A:
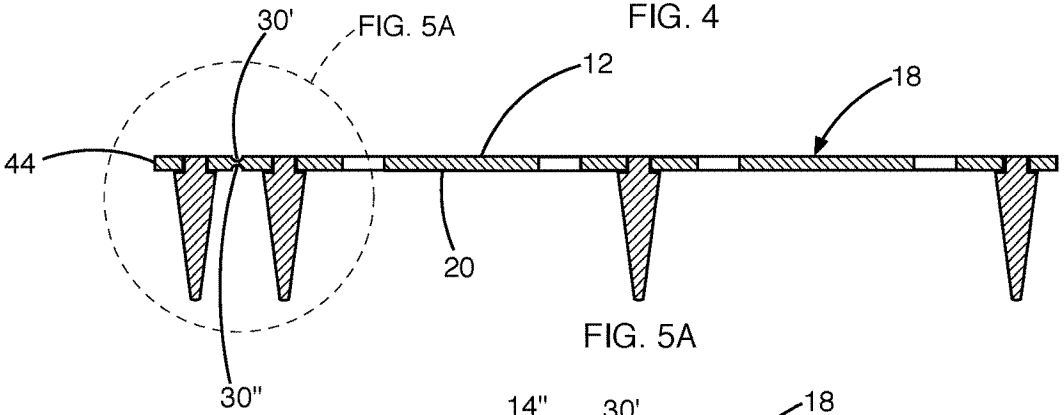
FIG. 5A is a cross-sectional side view of the insert for a cooler shown in FIG. 1.
Figure 5B:
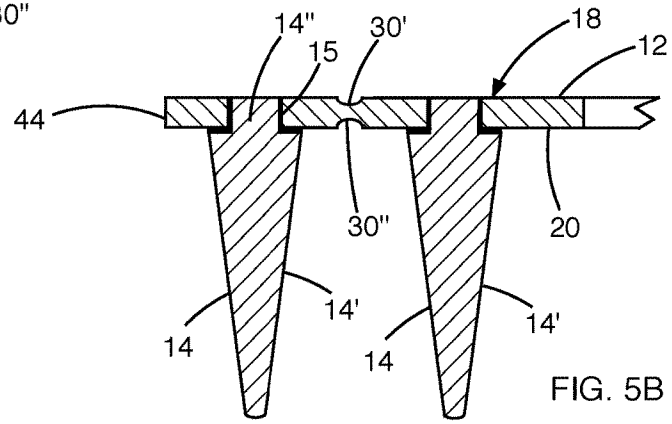
FIG. 5B is a partial close-up cross-sectional side view of the insert for a cooler shown in FIG. 5.

Similarly, as shown in FIGS. 5A and 5B, the bottom surface 20 of the plate 12 defines channel 30" that is aligned with and directly opposite the channel 30' in the top surface 18. The channel 30" extends from proximate the plate edge 40 to the plate edge 42 (see FIG. 3) and is parallel to and spaced approximately 1 inch from the long plate edge 44. As further shown in FIG. 5B, the legs 14 are each comprised of conical leg portion 14 having a wider top portion that narrows toward the distal end of the leg 14. The upper end portion 14" of the leg is cylindrical in shape and is sized and shaped to fit with a corresponding aperture 15 formed in the plate 12. The upper end portion 14" fits within the aperture 15, with a top end of the conical section 14' abutting against the bottom surface 20 of the plate 12. The upper end portion 14" is fixedly attached to the aperture 15 of the plate 12 as with an adhesive. Likewise, the legs 14 may be integrally formed with the plate 12 as may be the case if the legs 14 and plate 12 are molded as a single unit.

As shown in FIG. 6, the channels 30", 32", 34", 36" and 38" define breakaway sections 50, 52, 54, 56, 58, 60, 62, 64 and 66. In order to accommodate an interior cooler size that is smaller than a size of the entire plate 12, one or more breakaway sections 50, 52, 54, 56, 58, 60, 62, 64 and 66 can be removed from the plate 12 by bending the plate 12 along one of the channels 30", 32", 34", 36" or 38" until the plate 12 fractures along the selected channel and breaks away. The section or sections removed from the remaining portion of the plate 12 can be discarded. It should be noted that while the plate 12 is shown and described as having one pair of channels 30' and 30" extending along and spaced from the edge 44 and four pairs of channels 32' and 32", 34' and 34", 36' and 36" and 38' and 38" spaced from the edge 40, additional pairs of channels could be added in a similar manner to the pairs of channels 32' and 32", 34' and 34", 36' and 36" and 38' and 38" to allow for even more sizes of the plate 12 to be available.

Figure 7:
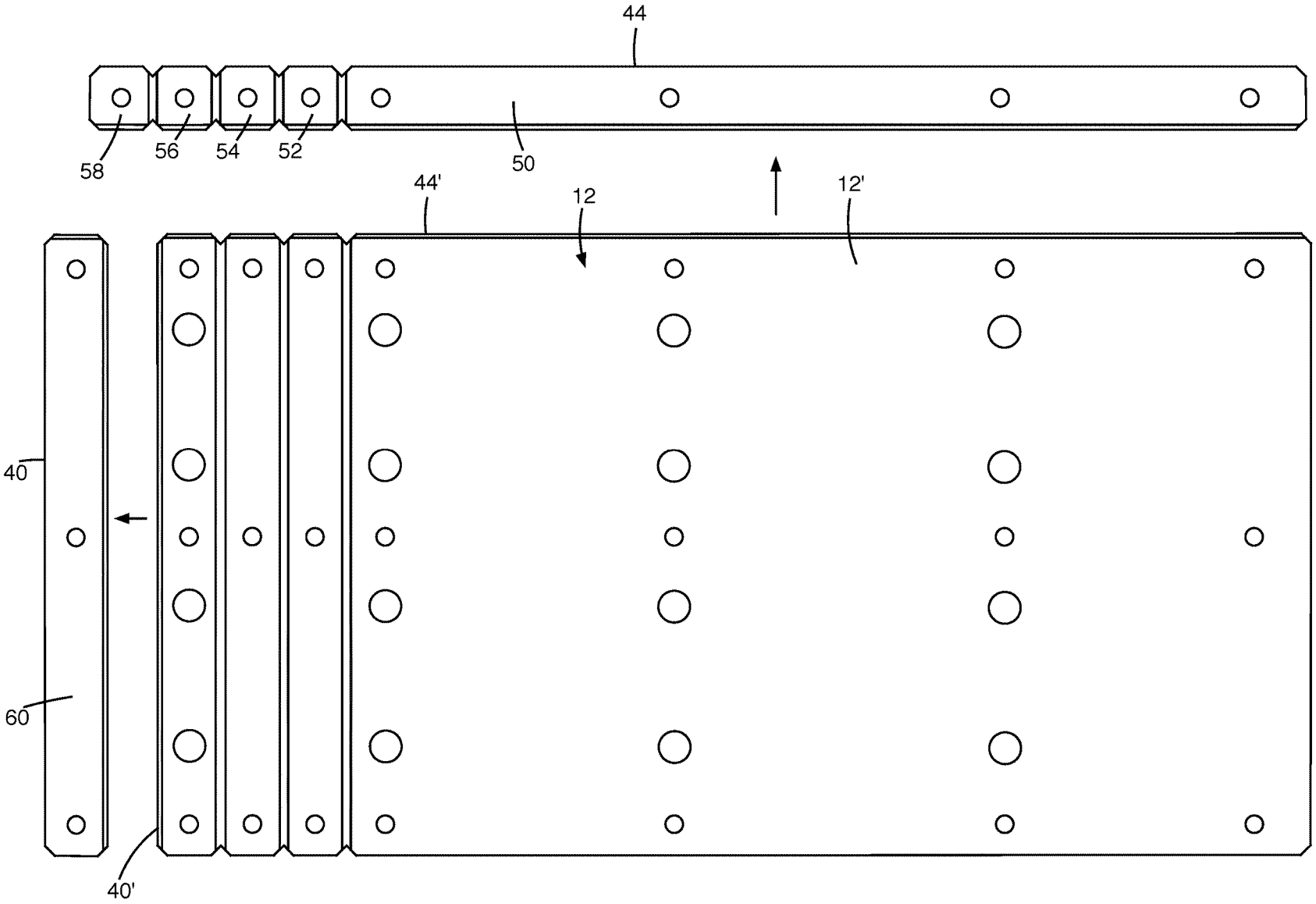
FIG. 7 is a plan top view of the insert for a cooler as shown in FIG. 1 with sections of the insert detached.

Thus, as shown in FIG. 7, in order to fit within a cooler whose length and width of the interior space are 1 inch or smaller than a length and width of the plate 12, the side sections 50, 52, 54, 56 and 58 are removed along edge 44 to form new edge 44' of the remaining portion of the plate 12'. Similarly, the side section 60 is removed along edge 40 to form new edge 40' of the remaining portion of the plate 12'. Removing these sections 50, 52, 54, 56, 58 and 60 effectively reduces the length and width of the plate 12 by 1 inch in both directions. Of course, while the sections 50, 52, 54, 56, 58 and 60 have been described as having 1 inch widths, other sizes could be used to either decrease the size of each removable section or increase the size of each removable section in order to accommodate more or less finite adjustment of the size of the plate 12.

Figure 8:
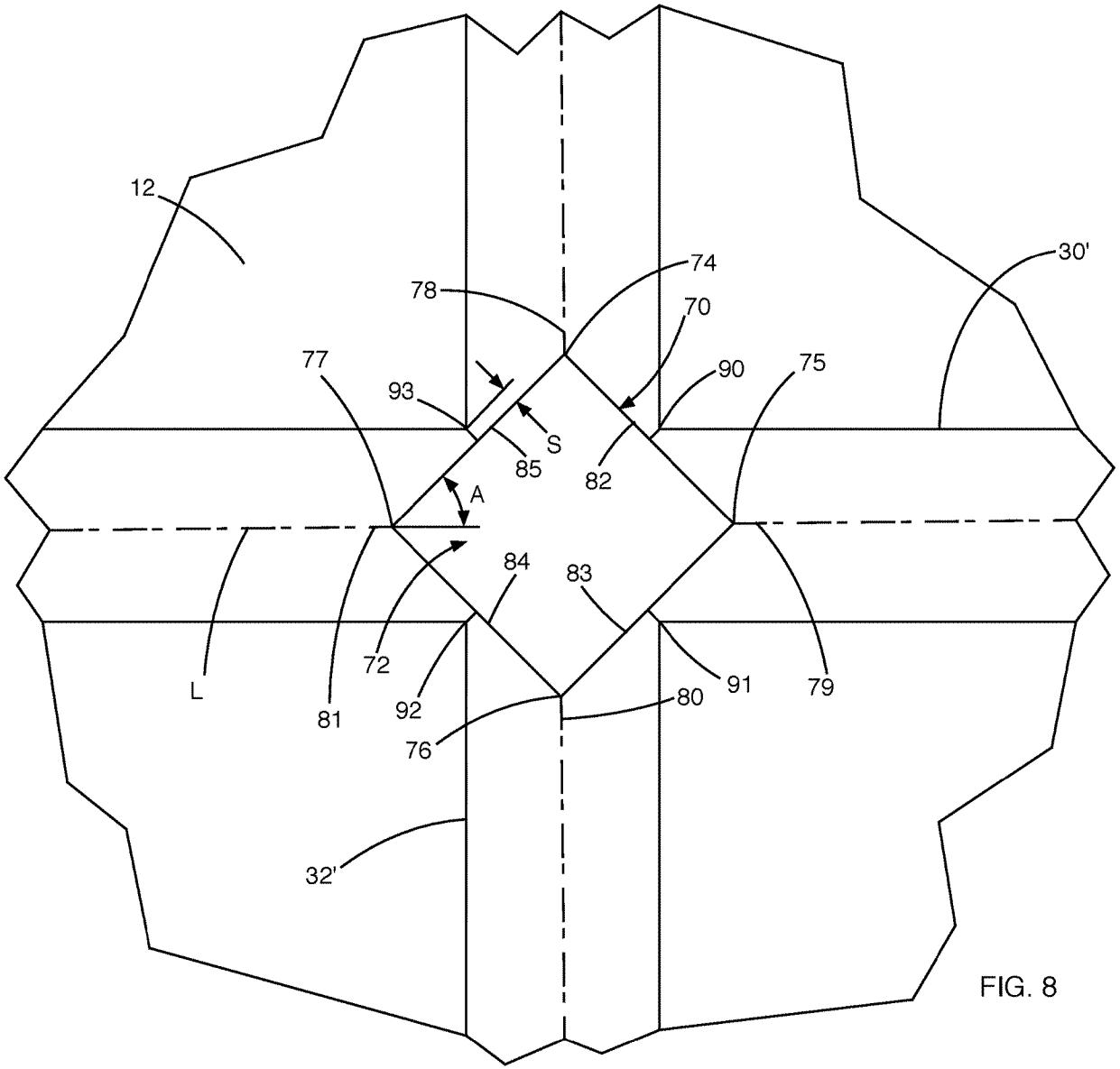
FIG. 8 is a partial close-up top plan view of the insert shown in FIG. 1.

FIG. 8 is a close-up detail of an intersection 70 of channels 30' and 32'. A square aperture 72 that extends through the plate 12 is positioned at the intersection 70 and is oriented so that the corners 74, 75, 76 and 77 are positioned at the low points 78, 79, 80 and 81, respectively, of the channels 30' and 32'. Thus, each of the interior faces 82, 83, 84 and 85 of the square aperture 72 are oriented at a 45 degree angle A to a long axis L of the respective channel. Additionally, each face 82, 83, 84 and 85 is spaced a distance S from a respective corner 90, 91, 92 and 93 defined by the intersection between adjacent sides of channels 30' and 32'.

Figure 9:
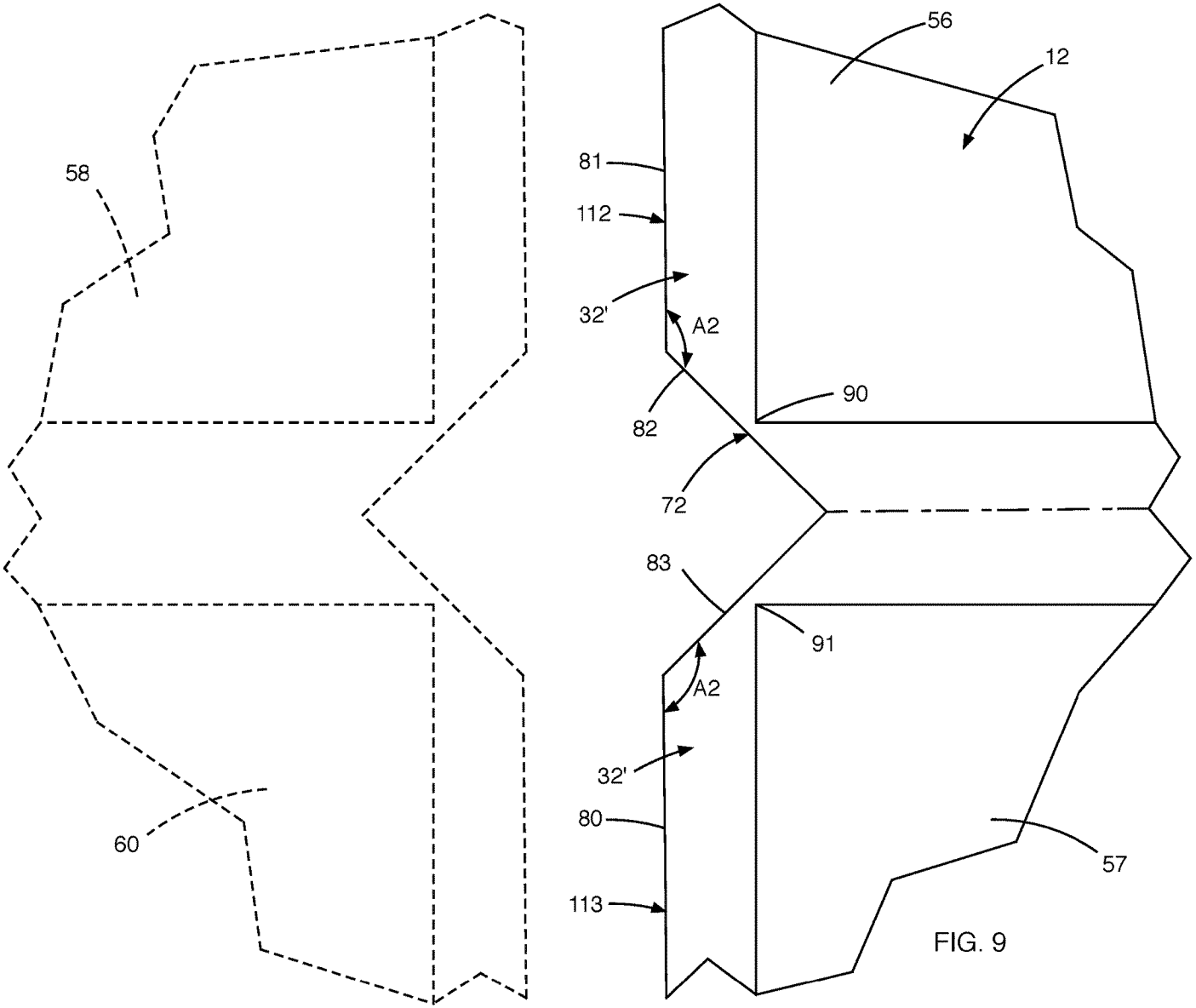
FIG. 9 is a partial close-up top plan view of the insert for a cooler as shown in FIG. 8 with sections of the insert detached.
Figure 10:
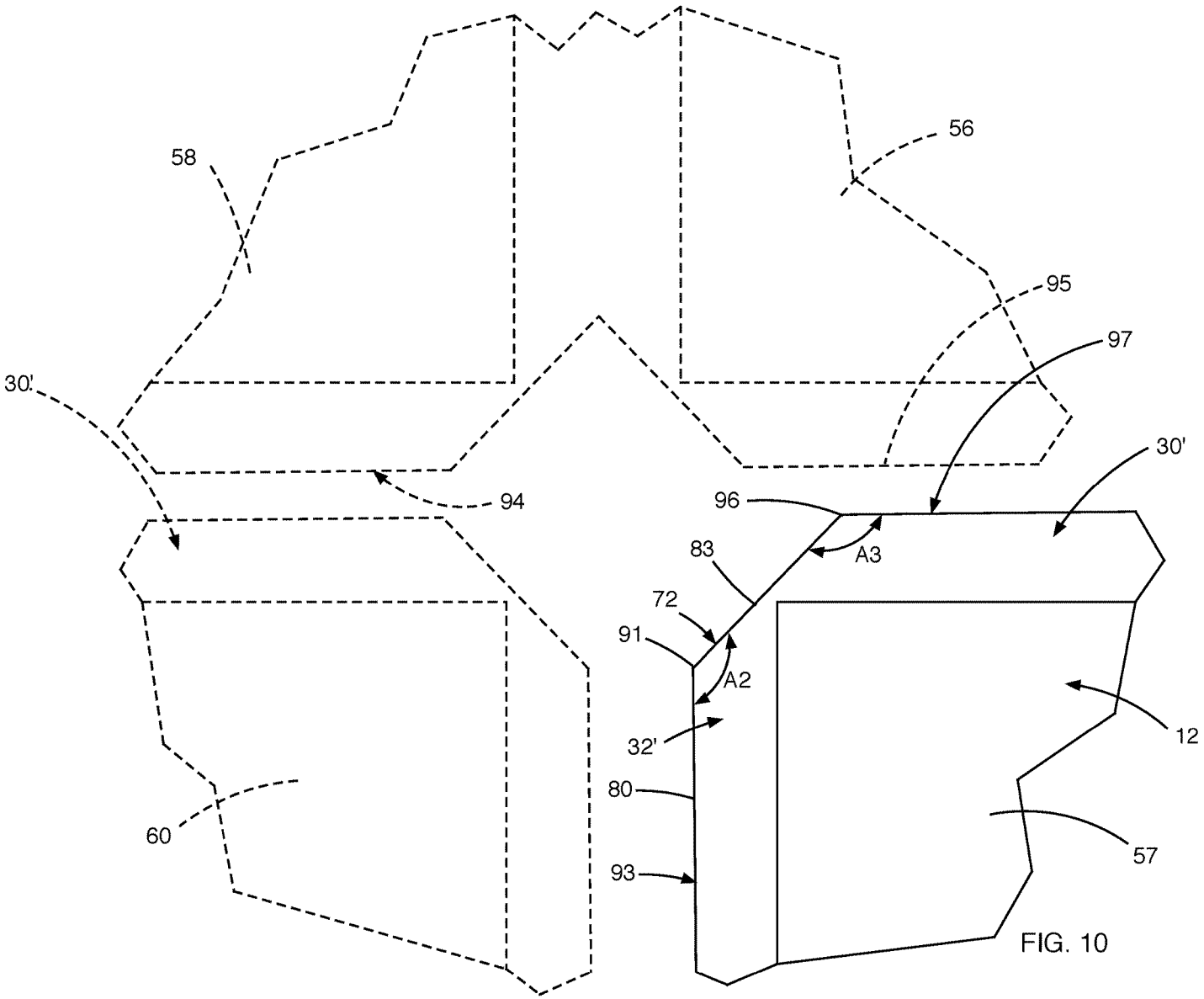
FIG. 10 is a partial close-up top plan view of the insert for a cooler as shown in FIG. 8 with sections of the insert detached.

FIGS. 9 and 10 show close-up details of the intersection 70 of channels 30' and 32' when portions of the plate 12 are separated to form a smaller cooler insert according to the present invention. In FIG. 9, plate portions 58 and 60 are separated from the remainder of the plate 12 to decrease the overall length of the plate 12 by the width of portions 58 and 60. Thus, if portions 58 and 60 are 1 inch in width, the plate 12 will be reduced in length by 1 inch upon removal of portions 58 and 60. To remove portions 58 and 60, sections 58 and 60 are bent back and forth relative to plate portions 56 and 57 to cause a stress fracture proximate the thinnest portions 80 and 81 of channel 32' occurs, at which point the plate portions 58 and 60 can be removed from the remainder of the plate 12 and discarded. The exposed faces 82 and 83 of the remainder of the square aperture 72 form corners 90 and 91, with the face 82 forming corner 90 with edge 112 and face 83 forming corner 91 with edge 113. The angle A2 between the face 82 and the edge 112 is approximately 135 degrees. This obtuse angle results in a corner 90 that is less sharp and therefore less likely to create a sharp edge that could cause injury as opposed to, for example, a 90 degree corner that would result if the aperture 72 was removed. The formation of less sharp corners when sections are removed from the plate are even more apparent when both lateral and longitudinal sections are removed from the plate as shown in FIG. 10.

In FIG. 10, plate portions 56, 58 and 60 (as well as plate portions 50, 52 and 54 as shown in FIG. 7) are separated from the remainder of the plate 12 to decrease the overall length of the plate 12 by removing portions 58 and 60 and to decrease the overall width of the plate 12 by removing portions 50, 52, 54 and 56. Thus, if portions 58 and 60 are 1 inch square and portions 50, 52, 54 and 56 are 1 inch wide, the plate 12 will be reduced in length by 1 inch and width by 1 inch upon removal of sections or portions 50, 52, 54, 56, 58 and 60. To remove sections or portions 50, 52, 54, 56, 58 and 60 (as shown in full in FIG. 7), portions or sections 50, 52, 54, 56, and 58 are bent back and forth relative to plate portions 60 and 57 to cause a stress fracture proximate the thinnest portions 94 and 95 of channel 30' occurs, at which point the plate portions 50, 52, 54, 56, and 58 can be removed from the remainder of the plate 12 and discarded. Likewise, as noted above, to remove portion 60, section 60 is bent back and forth relative to plate portion 57 to cause a stress fracture proximate the thinnest portion 80 of channel 32' occurs, at which point the plate portion 60 can be removed from the remainder of the plate 12 and discarded.

The exposed face 83 of the remainder of the square aperture 72 forms corners 91 and 96. The angle A2 between the face 83 and the edge 113 is approximately 135 degrees. Likewise, the angle A3 between the face 83 and the edge 97 is also approximately 135 degrees. These two obtuse angles A2 and A3 result in corners 91 and 96 that are less sharp and therefore less likely to create sharp edges that could cause injury as opposed to, for example, a corner that would result if the aperture 72 was circular. In this configuration, the combination of the corners 91 and 96 with the face 83 forms a softer edge, thereby forming a beveled corner by truncating the formation of a 90 degree corner that would be formed if the aperture 72 were not present at the intersection of the breakpoint of the channels 30' and 32'.

Figure 11:
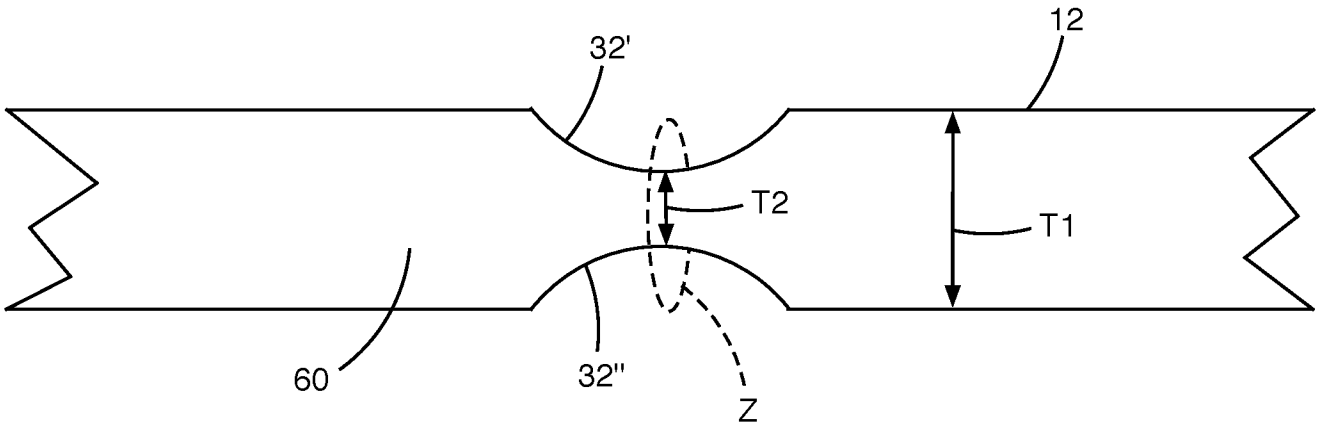
FIG. 11 is a partial close-up side plan view of the insert for a cooler as shown in FIG. 4.

As shown in FIG. 11, the plate 12 has a primary thickness T1 over substantially its entire length and width. The thickness T1 is determined based on the material used to form the plate 12 to provide sufficient rigidity and support for the weight of foodstuffs, ice and other products that may be placed on top of the plate when positioned within a cooler. Such weight can 100 pounds or more depending on the size of the cooler and the foodstuffs, ice and other products placed inside the cooler. As a result, the plate 12 must be formed from a material that is capable of supporting such weight, such as polystyrene having a thickness of 0.25 inches or more, or other materials known in the art. In addition, the material used to form the plate must have some brittleness to it that it can be forced to break along the size adjustment channels as previously described. Again, while other materials known in the art may also be suitable, polystyrene is able to be broken along the breakage channels when desired.

The breakage channels, such as channels 32' and 32" are each formed with a radius of approximately 0.12 inches, with the channels 32' and 32" positioned directly over one another and each having a width of approximately 0.15 to 0.25 inches. The square aperture 72 has a side length of approximately 0.2 to 0.25 inches but could be configured to be larger depending on the width of the corresponding channels. The thinnest portion having a thickness T2 forms a breakage zone Z where sections 60 and 62 can be separated from one another. That is, when section 60 is bent along the channels 32' and 32" relative to section 62, a fracture will occur in the breakage zone Z at the thinnest portion at thickness T2 so that a relatively straight break is formed along the bottoms of channels 32' and 32". The thickness T2 may be 0.05 inches or more so as to provide sufficient integrity of the plate 12 when breakage along the channels 32' and 32" is not desired, but thin enough to allow breakage when adjustment of the size of the plate 12 is desired. It is also noted that the use of polystyrene sheet material or other plastic materials having similar brittleness factor is desirable as such materials are not subject to corrosion when wet.

Figure 12:
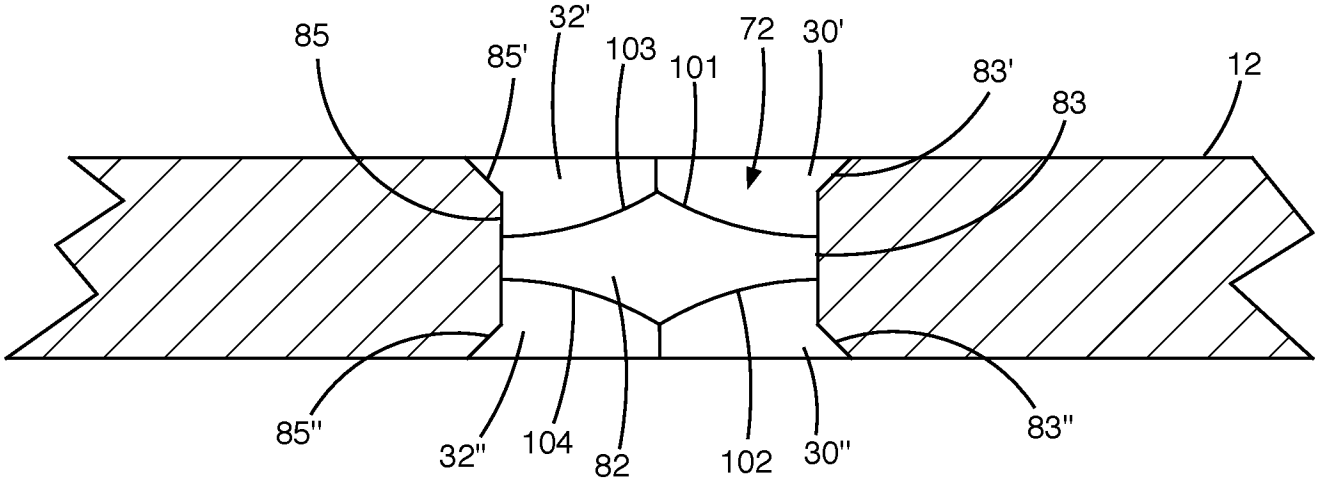
FIG. 12 is a partial cross-sectional close-up side view of the insert for a cooler as shown in FIG. 8.

As shown in FIG. 12, which illustrates a close-up cross-sectional view when taken diagonally across the square aperture 72 between corners 91 and 93 as shown in FIG. 8, it can be seen that the side wall 82 has curved top and bottom surfaces 101, 102, 103 and 104 formed by the curvature of the channels 30', 30", 32' and 32" respectively. The top and bottom edges 85' and 85" of face 85 are beveled by the intersection of the channels 30' and 32' and 30" and 32" at those locations. Likewise, the top and bottom edges 83' and 83" of face 83 are beveled by the intersection of the channels 30' and 32' and 30" and 32" at those locations. The combination of such contours and bevels combine to form a softer (i.e., less sharp) corner when sections of the plate 12 are separated from the plate regardless of which corner remains as part of the plate 12.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "left" and right", "front" and "rear", "above" and "below" and the like are used as words of convenience to provide reference points and are not to be construed as limiting terms.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

In addition, the foregoing describes only some embodiments of the inventions, and alterations, modifications, additions and/or changes can be made thereto without departing from the scope and spirit of the disclosed embodiments, the embodiments being illustrative and not restrictive.

Furthermore, inventions have been described in connection with what are presently considered to be the most practical embodiments, it is to be understood that the inventions are not to be limited to the disclosed embodiments, but to the contrary, are intended to cover various modifications and equivalent arrangements included within the spirit and scope of the inventions. Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

What is claimed is:

1. A cooler insert, comprising:

a rectangular planar plate defining a plurality of drainage apertures extending through the plate and spaced over a surface of the plate to provide drainage over an entirety of the plate at a location of each drainage aperture;

a plurality of legs depending from a bottom of the plate, the plurality of legs spaced about a perimeter of the plate and dispersed throughout a body of the plate to provide support of the plate over its entire surface and to support the plate above a bottom interior surface of a cooler;

the plate defining a first plurality of channels in a top surface of the plate, the plurality of channels spaced from and parallel to a first edge of the plate, each of the plurality of channels forming a first breakage zone along its length and forming at least one first removable section of the plate so that the at least one first removable section of the plate can be selectively removed from the plate by breaking the plate along the breakage zone to adjust a first dimension of the plate in a first direction;

the plate defining at least one second channel in the top surface of the plate, the at least one second channel oriented perpendicular to the first plurality of channels and spaced from and parallel to a second edge of the plate, the at least one second channel forming a second breakage zone along its length and forming at least one second removable section of the plate so that the at least one second removable section of the plate can be selectively removed from the plate by breaking the plate along the second breakage zone to adjust a second dimension of the plate in a second direction; and the plate defining a square aperture at each intersection of the first plurality of channels and the at least one second channel so as to form a beveled edge at a corner between one of the first plurality of channels and the at least one second channel when the plate is separated along the one of the first plurality of channels and the at least one second channel.

2. The cooler insert of claim 1, wherein each of the first removable section and the second removable section each have at least one of the plurality of legs attached thereto to support the first removable section and second removable section independently of the body of the plate and one another.

3. The cooler insert of claim 1, wherein a width and a length of the plate can be adjusted in approximately 1 inch increments by selectively removing one or more of the first and second removable sections.

4. The cooler insert of claim 1, further comprising a first plurality of bottom channels formed in a bottom surface of the plate, each of the first plurality of bottom channels aligned with and positioned directly opposite one of the first plurality of channels and further comprising at least one second bottom channel aligned with and positioned directly opposite the at least one second channel.

5. The cooler insert of claim 4, wherein each set of the first plurality of bottom channels and the first plurality of channels form a first elongated breakage zone and the at least one second bottom channel and the at least one second channel form a second elongated breakage zone.

6. The cooler insert of claim 5, wherein each channel extends from one plate edge to an opposite plate edge.

7. The cooler insert of claim 6, wherein the first and second elongated breakage zones define thinned sections in the plate along their respective lengths to facilitate breakage of the plate along their respective lengths to adjust a length or width of the plate.

8. The cooler insert of claim 2, wherein the plurality of legs are positioned about a perimeter of the plate to support edges of the plate and also laterally spaced over interior portions of the plate to support the body of the plate to prevent sagging over its entire surface when foodstuffs, ice or products are placed on top of the plate.

9. The cooler insert of claim 2, wherein each removable section is provided with one or more legs depending on a size of the removable section to prevent flexing of one removable section relative to an adjacent removable section that could otherwise cause breakage along a channel from weight being place on the plate or any removable section.

10. The cooler insert of claim 9, wherein each removable section is independently supported by one or more of the plurality of legs in a manner and configuration similar to an adjacent removable section or body of the plate.

11. The cooler insert of claim 1, wherein the plate includes a plurality of apertures sized and shaped to receive a proximal end of one of the plurality of legs to secure the one of the plurality of legs to the plate.

12. The cooler insert of claim 1, wherein the plate and legs are integrally molded together.

13. The cooler insert of claim 1, wherein each of the legs is conical in shape having a wider top portion adjacent the plate and that narrows toward a distal end of the leg.

14. The cooler insert of claim 1, wherein each of the plurality of square apertures is oriented so that corners of the aperture are positioned at a respective low point of one of the first plurality of channels or at least one second channel.

15. The cooler insert of claim 14, wherein each interior face of the square aperture is oriented at a 45 degree angle to a long axis of the respective channel.

16. The cooler insert of claim 15, wherein each interior face of the square aperture is spaced a distance from a respective channel corner defined by an intersection between adjacent sides of intersecting channels.

17. The cooler insert of claim 16, wherein a first angle between a face of the square aperture and a first adjacent edge of a first broken channel is approximately 135 degrees.

18. The cooler insert of claim 17, wherein a second angle between the face of the square aperture and a second adjacent edge of a second broken channel opposite the first broken channel is approximately 135 degrees to form a beveled corner between the first adjacent edge and the second adjacent edge.

19. The cooler insert of claim 1, wherein the plate is formed from polystyrene.

* * * * *